US006282385B1

(12) United States Patent
Suto

(10) Patent No.: US 6,282,385 B1
(45) Date of Patent: Aug. 28, 2001

(54) DEVELOPING DEVICE AND IMAGE FORMING APPARATUS USING THE SAME

(75) Inventor: Masaki Suto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/631,108

(22) Filed: Aug. 1, 2000

(30) Foreign Application Priority Data

Sep. 30, 1999 (JP) ..... 11-278469

(51) Int. Cl.[7] ..... G03G 15/06; G03G 15/08
(52) U.S. Cl. ..... 399/55; 399/282
(58) Field of Search ..... 399/285, 222, 399/53, 55

(56) References Cited

U.S. PATENT DOCUMENTS 5,500,721 * 3/1996 Randall et al. ..... 399/222 X
5,860,040 * 1/1999 Shimizu et al. ..... 399/55
6,173,144 * 1/2001 Hirabayashi et al. ..... 399/222

FOREIGN PATENT DOCUMENTS 61-198170 9/1986 (JP) .
4-35074 6/1992 (JP) .
7-64379 3/1995 (JP) .
8-202176 8/1996 (JP) .
11-133809 5/1999 (JP) .

* cited by examiner

*Primary Examiner*—Susan S. Y. Lee
(74) *Attorney, Agent, or Firm*—Morgan, Lewis & Bockius LLP

(57) ABSTRACT

A control unit is configured in such a manner that at a transition from a developing state to a non-developing state both of DC and AC components of a development bias that are superimposed on each other are instantaneously interrupted after the duty factor of the portion of the AC component having the opposite polarity to the developer charging polarity is gradually increased.

7 Claims, 8 Drawing Sheets

DEVELOPING DEVICE AND IMAGE FORMING APPARATUS USING THE SAME

BACKGROUND OF THE INVENTION

1. Field of the Invention

The present invention relates to a developing device used in image forming apparatuses such as printers, copiers, and facsimile machines that utilize an electrophotography process, an electrostatic recording process, or the like, as well as to an image forming apparatus using such a developing device. In particular, the invention relates to a developing device that develops an electrostatic latent image formed on an image carrying body by using an AC bias as well as to an image forming apparatus using such a developing device.

2. Description of the Related Art

In conventional developing devices that are used, to develop an electrostatic image formed on an image carrying body such as a photoreceptor drum, in image forming apparatuses such as printers, copiers, and facsimile machines that utilize an electrophotography process, an electrostatic recording process, or the like, a technique of applying an AC bias to a developing roller is used widely.

In such developing devices, an oscillating electric field is formed between the developing roller and the photoreceptor drum by applying an AC bias to the developing roller and the oscillating electric field causes developer (hereinafter referred to as "toner") to fly (reciprocate) between the developing roller and the photoreceptor drum, whereby the development efficiency is increased and fogging and the like are prevented.

In image forming apparatuses using such a developing device, there may occur an event that toner sticks to the photoreceptor drum in band-like form when an AC bias being applied to the developing roller is turned off at the end of an electrostatic image development process.

Such sticking of toner (hereinafter referred to as "toner spewing" at the time of turning off of a development bias) occurs in such a manner that in the development region where the developing roller and the photoreceptor drum exist close to each other, when an AC development bias being applied to the developing roller is turned off, van der Waals force, image force, or the like causes toner that is not returned to the developing roller to remain on the surface of the photoreceptor drum in a region where no electrostatic image exists.

In the toner spewing effect at the time of turning off of a development bias, toner particles that are given reciprocative acceleration by the AC electric field force generated by the development bias and that should remain on the developing roller after extinction of the AC electric field force because of their positions, acceleration directions, mass, and charge amounts at the time of the extinction are absorbed on the surface of the photoreceptor drum instead. It is known that because of the above mechanism the amount of spewed toner tends to be influenced by variations in the mass and the charge amounts of toner particles due to moisture absorption and hence is greatly affected by the use environment of the image forming apparatus.

The toner spewing phenomenon not only causes undue consumption of toner but also increases the load on the cleaner. In contact transfer type image forming apparatuses having a transfer roller that directly contacts the photoreceptor drum, bandlike toner remaining on the photoreceptor drum is transferred to the transfer roller and then transferred from the transfer roller to the back surface of a sheet during the next image formation, which means secondary problems such as staining of the back surface of a sheet.

As for techniques capable of preventing the toner spewing out of the developing roller at the time of turning off of a development bias, Japanese Examined Patent Publication No. Hei. 4-35074 discloses a technique in which when a charged surface portion having a uniform potential of the image forming body passes the development region after a latent image portion of the image forming body passed the same region, the bias voltage is changed in such a manner that the maximum voltage of a bias voltage having the same polarity as the uniform potential decreases, whereby a shock at the time of turning off of the bias voltage is reduced and the toner spewing amount is decreased. Japanese Unexamined Patent Publication Nos. Hei. 7-64379 and Hei. 8-202176 propose, with attention paid to the direction of an AC electric field in a jumping development method, an AC-frequency-and-phase-limited development bias turning-off control in which a bias is always turned off in a state that reciprocating toner is moving toward the developing roller. Japanese Unexamined Patent Publication No. Hei. 11-133809 proposes a technique in which during image formation the turning-off itself of a development bias is not performed between pages, whereby the degree of the toner spewing phenomenon is lowered.

However, the above conventional techniques have the following problems. In image forming apparatuses of the AC bias application development type, an AC development bias voltage is applied between the image carrying body and the developer carrying body, whereby an electric field causes plural toner particles existing in the development region where the image carrying body and the developer carrying body are located close to each other to always reciprocate is generated. It is known that constraining force acts on each toner particle in such a manner that its strength depends on the charge amount and the mass of each toner particle.

In particular, in what is called a jumping development method in which the image carrying body and the developer carrying body are separated from each other but located close to each other and an AC development bias is applied, a region (called "toner cloud") where plural toner particles always fly in a reciprocated manner is formed in the space (called "development gap") between the image carrying body and the developer carrying body. The positions, the movement speeds, and the movement directions of the toner particles in the toner cloud region are varied by the time-varying AC electric field. In general, the jumping development method has a problem that it is much more difficult to lower the degree of the toner spewing phenomenon in a stable manner, that is, to establish a state that all toners are returned to the developer carrying body when the development bias is turned off, than in the contact method in which the image carrying body and the developer carrying body are in contact with each other.

In contrast, in the case where, as disclosed in the publication No. Hei. 4-35074, for example, the maximum voltage of the same polarity as the potential of the surface of the image carrying body is gradually decreased, that is, the peak-to-peak voltage of the AC bias is decreased, the movement energies of the toner particles in the toner cloud region decrease and toner particles located close to the surface of the image carrying body cannot return to the developer carrying body and remain on the surface of the image carrying body. If the DC bias is decreased without decreasing the peak-to-peak value of the AC bias, although normally charged toner particles can be attracted to the developer carrying body, what is called "opposite polarity toners," that is, part of the toner particles that are small in charge amount or charged in opposite polarity are positively moved to the image carrying body because the electric field between the image carrying body and the developer carrying body becomes too much stronger than in the developing state (phenomenon called "fogging of opposite polarity"); toner spewing still occurs.

In the AC-frequency-and-phase-limited development bias turning-off control disclosed in the publication Nos. Hei. 7-64379 and Hei. 8-202176 in which the phase of the AC voltage in the jumping development method is controlled so that the bias is always turned off in a state that reciprocating toner particles are moving toward the developing roller, the movement of clouds in which developer is always reciprocating between the image carrying body and the developer carrying body is not such that all developer returns to the developer carrying body in the return phase of one cycle. Therefore, this technique has a problem that developer located close to the image carrying body, toner that is unfavorable in terms of charging (described above), etc. cannot be returned completely and hence the toner spewing cannot be prevented effectively.

The method disclosed in the publication No. Hei. 11-133809 in which the turning-off itself of a development bias is not performed between pages during image formation to avoid toner spewing out of the developer roller at the time of turning-off of the development bias is just a countermeasure for continuous image formation; it is definitely necessary to turn off a development bias at the end of image formation. Therefore, this is not an essential measure.

SUMMARY OF THE INVENTION

The present invention has been made in view of the above circumstances, and provides a developing device capable of reducing, as much as possible for differences among individual developing devices, various use environments, and variations with time, the degree of the toner spewing phenomenon in which toner sticks to the surface of the image carrying body at the end of development in a developing device and an image forming apparatus using an AC development bias without complicating the device or the image formation control, as well as an image forming device using such a developing device.

The invention also makes it possible to produce a good image with no toner stain formed on the back surface etc. of a sheet under every combination of conditions.

According to a first aspect of the invention, there is provided a developing device in which a developer carrying body that carries a developer is disposed to face an image carrying body and an electrostatic latent image formed on the image carrying body is developed by applying a bias voltage in which DC and AC components are superimposed on each other to the developer carrying body, having a control unit that performs, at a transition from a developing state to a non-developing state, a control that both of the superimposed DC and AC components are instantaneously interrupted after a duty factor of a portion of the AC component having an opposite polarity to a developer charging polarity is gradually increased.

That is, in a developing device that performs development in such a manner that an electric field for moving charged developer (toner) toward electrostatic latent image portions formed on the image carrying body and an electric field for separating charged toner from background white portions having no electrostatic latent image are formed by a DC component of a development bias voltage applied to the developer carrying body and the movements of charged toner particles existing between the developer carrying body and the image carrying body are activated by giving reciprocative acceleration to them by an AC component, at a transition from a developing state to a non-developing state a control is performed in such a manner that both development biases of the applied DC and AC components are instantaneously interrupted after all toner particles are returned to the developer carrying body, while the acceleration for moving charged toner particles existing between the developer carrying body and the image carrying body toward the developer carrying body and the time during which the toner particles move toward the developer carrying body are increased by gradually increasing the duty factor of the portion of the AC component having the opposite polarity to the developer charging polarity. This prevents toner from being kept stuck to the image carrying body.

According to a second aspect of the invention, there is provided a developing device in which a developer carrying body that carries a developer is disposed to face an image carrying body and an electrostatic latent image formed on the image carrying body is developed by applying a bias voltage in which DC and AC components are superimposed on each other to the developer carrying body, having a control unit that performs, at a transition from a developing state to a non-developing state, a control that a duty factor of a portion of the AC component having an opposite polarity to a developer charging polarity is gradually increased and a peak value of the portion of the AC component having the opposite polarity to the developer charging polarity is converged to 0 V.

In this developing device, while the control unit gradually increases the duty factor of the portion of the AC component having the opposite polarity to the developer charging polarity to increase the acceleration component and the movement time necessary for moving charged toner particles existing between the developer carrying body and the image carrying body toward the developer carrying body and thereby return all toner particles to the developer carrying body, the control unit gradually converges the peak value of the portion of the AC component having the opposite polarity to the developer charging polarity of the applied AC voltage to 0 V to gradually weaken and finally zero the AC electric field force acting on the toner particles to thereby establish a state that is equivalent to a state that the development bias is turned off. This prevents toner from being kept stuck to the image carrying body.

According to a third aspect of the invention, in the developing device according to the first aspect, the control unit stops increasing the duty factor at a time point when the duty factor has reached a prescribed value that is 80% or more.

With this measure, sufficient acceleration and movement time necessary for moving charged toner particles existing between the developer carrying body and the image carrying body toward the developer carrying body can be secured and hence all toner particles are returned to the developer carrying body. This prevents toner from being kept stuck to the image carrying body.

According to a fourth aspect of the invention, in the developing device according to the first aspect, the control unit sets a rate of increasing the duty factor at 1.0%/ms or less.

With this measure, the number of toner particles that escape from the binding force of the electric field and come to stick to the surface of the image carrying body because of unduly unbalanced duty factor modulation is decreased and all toner particles are returned to the developer carrying body. This prevents toner from being kept stuck to the image carrying body.

According to a fifth aspect of the invention, in the developing device according to first aspect, the control unit instantaneously interrupts both of the superimposed DC and AC components in such a phase range that the AC component has the opposite polarity to the developer charging polarity.

That is, in a developing device that performs development in such a manner that an electric field for moving charged developer (toner) toward electrostatic latent image portions formed on the image carrying body and an electric field for separating charged toner from background white portions having no electrostatic latent image are formed by a DC component of a development bias voltage applied to the developer carrying body and the movements of charged toner particles existing between the developer carrying body and the image carrying body are activated by giving reciprocative acceleration to them by an AC component, at a transition from a developing state to a non-developing state the control unit gradually increases the duty factor of the portion of the AC component having the opposite polarity to the developer charging polarity to increase the acceleration for moving charged toner particles existing between the developer carrying body and the image carrying body toward the developer carrying body and the time during which the toner particles move toward the developer carrying body, and the control unit instantaneously interrupts the development bias during a period when the binding force of the electric field for moving toner particles toward the developer carrying body acts on the toner particles, to thereby return all toner particles to the developer carrying body. This prevents toner from being kept stuck to the image carrying body.

BRIEF DESCRIPTION OF THE DRAWINGS

Preferred embodiments of the present invention will be described below in detail based on the following figures, wherein.

DETAILED DESCRIPTION OF THE PREFERRED EMBODIMENTS

Embodiments of the present invention will be hereinafter described with reference to the accompanying drawings.

Embodiment 1

Figure 1:
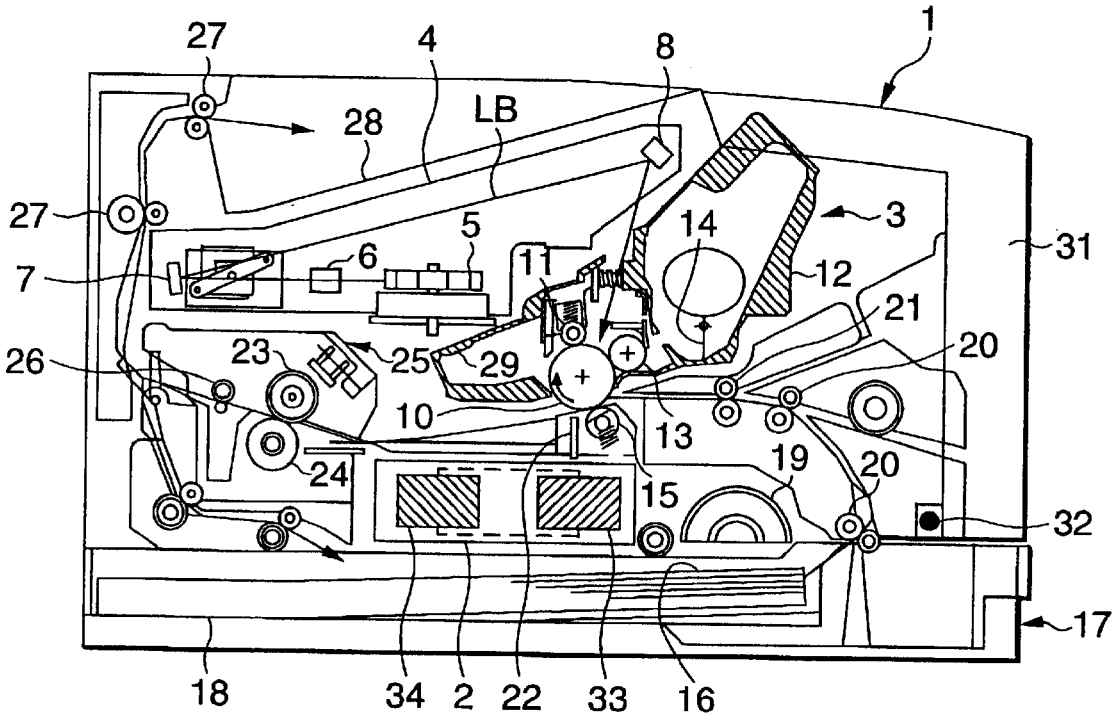
FIG. 1 shows the configuration of an image forming apparatus according to a first embodiment of the present invention.

FIG. 1 shows a laser beam printer as an image forming apparatus according to a first embodiment of the invention. FIG. 1 is a side view of the laser beam printer and the front surface of the laser beam printer is located on the left side in FIG. 1.

In FIG. 1, reference numeral 1 denotes the main body of the laser beam printer. An image processing section 2 for performing prescribed image processing on image information that is input externally and an image output section 3 for outputting an image based on the image information that has been subjected to the prescribed image processing in the image processing section 2 are provided inside the laser beam printer main body 1. Image information supplied from a host computer (not shown) such as a personal computer, transmitted over a communication line such as a telephone line or a LAN, or read out by an image reading apparatus (not shown) is input to the image processing section 2 in the laser beam printer main body 1.

The image output section 3 of the laser beam printer main body 1 is provided with a laser scanning device 4 that performs image exposure based on an image signal that has been subjected to the prescribed image processing in the image processing section 2. A semiconductor laser (not shown) that emits laser light while modulating it in accordance with an image signal is provided in the laser scanning device 4. A laser beam LB emitted from the semiconductor laser shines on a polygon mirror 5 and deflected for scanning by the polygon mirror 5 in accordance with its rotation. The deflected laser beam LB is passed through an fθ lens 6, reflected by two mirrors 7 and 8, and then output from the laser scanning device 4.

A photoreceptor drum 10 as an image carrying body that rotates at a constant speed is disposed on the path of the laser beam LB that is output from the laser scanning device 4. The laser beam LB that is output from the laser scanning device 4 scans the photoreceptor drum 10 in its axial direction (main scanning direction) at a prescribed exposure position. A charging roller 11, which is disposed slightly upstream of the exposure position and close to the photoreceptor drum 10, charges the surface of the photoreceptor drum 10 uniformly. The charging device may be in any form as long as it can charge the surface of the photoreceptor drum 10 uniformly; examples of the charging device other than the charging roller are corona chargers such as a screen corotron and a corotron.

An electrostatic latent image corresponding to image information is formed on the surface of the photoreceptor drum 10 by applying the laser beam LB to the charged surface of the photoreceptor drum 10. The electrostatic latent image is developed by a developing device 12 in a region located downstream of the exposure position. A developing roller 13 for developing an electrostatic latent image by bristling toner magnetically, a toner supply mechanism 14 for supplying toner from inside the developing device 12 to the developing roller 13, and other components are provided in the developing device 12. A prescribed development bias is applied to the developing roller 13.

As the photoreceptor drum 10 rotates, a toner image that has been formed by the development by the developing device 12 is moved to a nipping position of a transfer roller 15 and transferred electrostatically to a recording sheet 16 (plain paper). Each of the charging roller 11 and the transfer roller 15 used in this embodiment is configured in such a manner that a core metal member is covered with a cylindrical semiconductive member and the core metal member is provided with a voltage application terminal at one end.

Next, the transport route of a recording sheet 16 will be described briefly. Recording sheets 16 are stacked in a cassette tray 18 that has been inserted, from the front side, in a sheet feeder 17 that is detachably provided at the bottom of the laser beam printer main body 1. The top recording sheet 16 in the cassette tray 18 is picked out of the tray 18 by a semicircular sheet feeding roller 19. Some other feeding member such as a retard roller may be used instead of the sheet feeding roller 19.

The recording sheet 16 thus fed is transported by a transport roller 20 along a route indicated by a broken line in FIG. 1 and stopped at a time point when its front end has reached a registration roller 21. Then, an electromagnetic clutch (not shown) operates in synchronism with the rotation position of the photoreceptor drum 10, whereby the registration roller 21 starts rotating and the recording sheet 16 is transported at a constant speed in a stable manner. In this manner, the recording sheet 16 passes between the photoreceptor drum 10 and the transfer roller 15 with prescribed timing. Only at the time point when the recording sheet 16 passes between the photoreceptor drum 10 and the transfer roller 15, a transfer voltage is applied to the transfer roller 15 to cause discharge.

As a result, a toner image on the photoreceptor drum 10 is attracted electrostatically toward the transfer roller 15 and transferred to the recording sheet 16. The back surface of the toner-image-transferred recording sheet 16 is discharged by charge removing needles 22 that are disposed downstream of the transfer roller 15 and the recording sheet is thereby peeled off the drum surface.

The recording sheet 16 thus peeled off is transported along a transport route of a prescribed length to release tension and reaches a fusing device 25 that is composed of a heat roller 23 and a pressure roller 24. While passing between the heat roller 23 and the pressure roller 24, the recording sheet 16 that has been transported to the fusing device 25 is nipped by those rollers over a prescribed length. At this time, the toner-image-transferred surface of the recording sheet 16 faces the heat roller 23 and the pressure roller 24 presses the recording sheet 16 against the heat roller 23 to enable efficient heat transfer.

The temperature of the heat roller 23 is controlled so as to be kept at a constant, high temperature. In this state, the toner image that was transferred to the recording sheet 16 is fused thermally onto the sheet surface. An output roller 26 is disposed on the output side of the fusing device 25. The recording sheet 16 that has been transported to the output roller 26 is discharged to a discharge tray 28 that is provided at the top of the laser beam printer main body 1 by a discharge roller 27. Going along the above-described route, the recording sheet 16 is discharged with its recording surface down. This makes it possible to staple recording sheets 16 that have been subjected to printing in order page by page and are arranged in discharged order.

On the other hand, toner that was not transferred to the recording sheet 16 is removed from the drum surface by a cleaning device 29 that is disposed downstream of the transfer roller 15. The cleaning device 29 has a blade 29*a* for scraping toner off the drum surface and a film 29*b* for preventing toner leakage.

Figure 2:
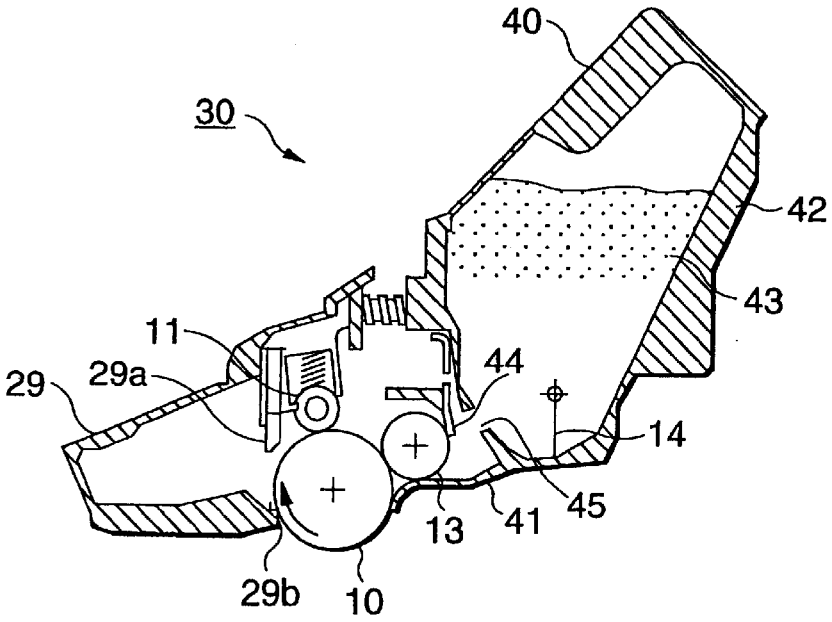
FIG. 2 is a schematic sectional view of a process cartridge used in the first embodiment in which image forming members are integrated.

In the laser beam printer according to this embodiment, as shown in FIG. 2, the photoreceptor drum 10, the cleaning device 29, the charging roller 11, and the developing device 12 are integrated to form a process cartridge 30, which is detachable from the laser beam printer main body 1.

The laser beam printer according to this embodiment has a front cover 31 that can be opened and closed with a hinge 32 as the rotation center. By opening the front cover 32, the user can remove a jammed sheet or replace the process cartridge 30 or the transfer roller 15 very easily. Further, the laser beam printer according to this embodiment is so configured as to allow the user to mount or remove the fusing device 25 easily.

A high-voltage power source section 33, which is disposed under the transfer roller 15, supplies necessary power to the individual components such as the process cartridge 30 and the fusing device 25. A control device 34, which is disposed on one side of the high-voltage power source section 33, performs electrical controls of the laser beam printer. The image processing section 2, which is disposed behind the high-voltage power source section 33 and the control device 34, translates image information that is supplied from a computer or the like into a language of the laser beam printer and supplies the resulting information to the control device 34.

FIG. 2 shows, in such a manner that it is included in the process cartridge, the configuration of the developing device 12 used in the above laser beam printer.

As shown in FIG. 2, the developing device 12 has a developing device housing 40, which is generally composed of a developing tank 41 that is provided with the developing roller 13 as the developer carrying body and a developer storage tank 42 that is disposed in the rear of the developing tank 41 and communicates with it. The developing tank 41 of the developing device housing 40 is provided with the rotatable developing roller 13 at the end on the side of the photoreceptor drum 10. As is well known, the developing roller 13 is composed of a fixed magnet roller (not shown) that is magnetized so as to have magnetic poles of prescribed polarities at prescribed positions and a developing sleeve (not shown) that is disposed outside the outer circumferential surface of the magnet roller so as to be rotatable in the direction indicated by an arrow in FIG. 2.

A charging blade 44 as a charging member for charging, by frictional electrification, into a prescribed polarity (minus), one-component magnetic developer (toner) 43 that is absorbed on the outer circumferential surface of the developing roller 13 by magnetic force of the magnetic roller (not shown) is disposed adjacent to the outer circumference of the developing roller 13. The charging blade 44 may be entirely made of a synthetic resin or the like, or may be composed of a leaf spring member made of a metal or the like and a frictional electrification member made of a synthetic resin or the like that is fixed to the tip portion of the leaf spring member by bonding or the like. The basal portion of the charging blade 44 is fixed to the developing device housing 40 and its tip portion is in pressurized contact with the surface of the developing roller 13 at a prescribed pressure.

As shown in FIG. 2, an opening 45 for restricting the amount of developer 43 to be supplied from the developer storage tank 42 to the developing tank 41 is formed between the developing tank 41 and the developer storage tank 42 that is located in the rear of the developing tank 41. If necessary, plural ribs (not shown) that partition the opening 45 are arranged in the opening 45 at prescribed intervals in the longitudinal direction.

The developer storage tank 42 is made large enough to store a prescribed amount of developer 43 that is a magnetic one-component toner, for example. The developer storage ratio of the developer storage tank 42, that is, the ratio of the developer 43 to the volume of the developer storage tank 42 is set at 60–70%, for example. A developer stirring/transport member 14 for transporting the developer 43 that is stored in the developer storage tank 42 to the developing tank 41 while stirring it is rotatably provided inside the developer storage tank 42. The developer stirring/transport member 14 is rotationally driven, with prescribed timing, via gears etc. that are provided behind the developing device 12, by a driving motor (not shown) that drives the photoreceptor drum 10 etc.

Incidentally, in this embodiment, a control unit is provided that performs, at a transition from a developing state to a non-developing state, a control of instantaneously interrupting both DC and AC components of a development bias that are superimposed on each other after gradually increasing the duty factor of the portion of the AC component having the opposite polarity to the developer charging polarity.

Figure 3:
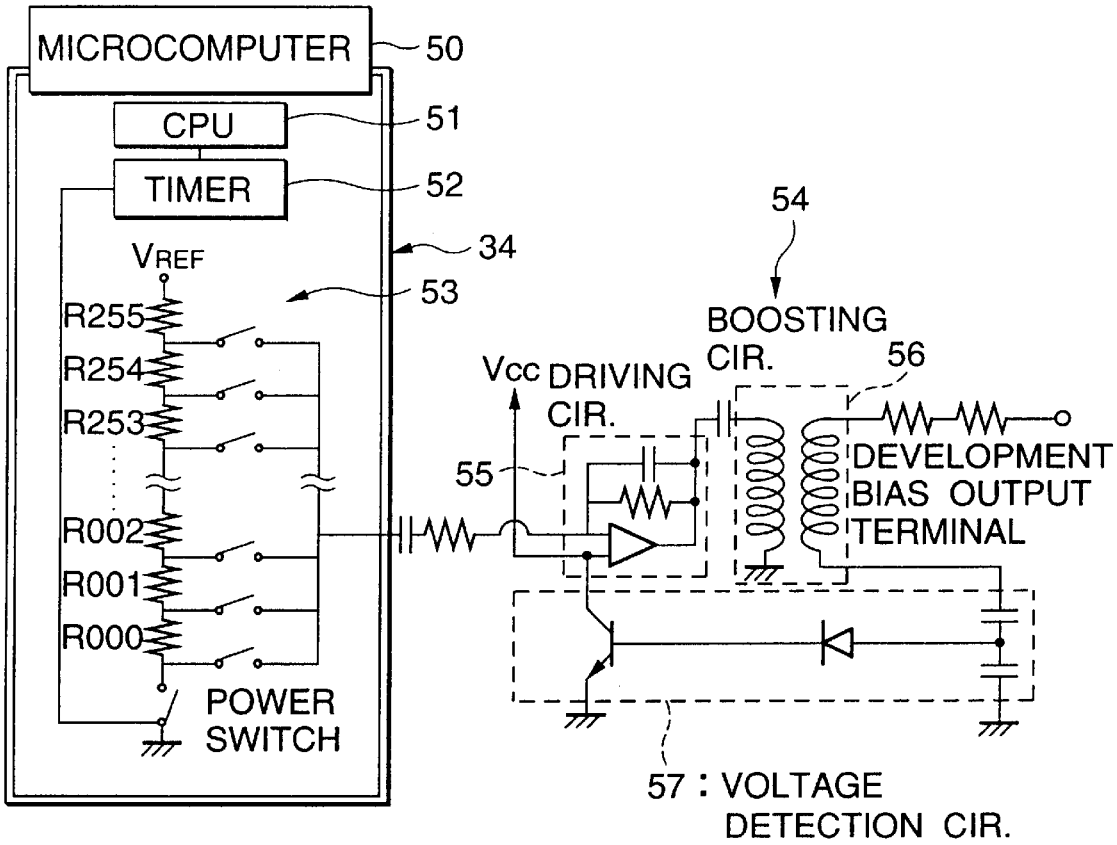
FIG. 3 is a circuit diagram of a control device and a high-voltage power source section that are used in the first embodiment.

FIG. 3 shows a development bias generation section that is part of the highvoltage power source section of the laser beam printer as well as a development bias output control circuit in the control device 34. That is, FIG. 3 shows circuit configurations of a duty factor variable control section and a development AC bias generation device capable of changing the peak-to-peak value of an AC voltage.

Figure 4:
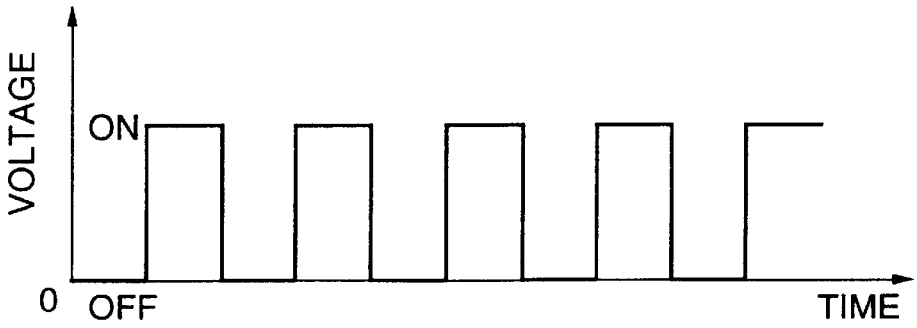
FIG. 4 is a pre-amplification waveform of an AC development bias as output from a microcomputer in the first embodiment.

The control device 34 for controlling the printing sequence of the laser beam printer includes a microcomputer 50. By turning on/off an internal D/A circuit 53 by using a timer 52, a CPU 51 of the microcomputer 50 causes a digital signal as shown in FIG. 4 to be output to a development bias output circuit 54 in the high-voltage power source section. The development bias output circuit 54 in the high-voltage power source section boosts the digital signal as shown in FIG. 4 to an AC bias voltage having a desired duty factor and a peak-to-peak value and superimposes a prescribed DC voltage to it, and applying a resulting bias voltage to the developing roller 13 of the developing device 12. At a transition from a developing state to a non-developing state, the CPU 51 performs a control of instantaneously interrupting both DC and AC components of a development bias that are superimposed on each other after gradually increasing the duty factor of the portion of the AC component having the opposite polarity to the developer charging polarity.

Figure 5:
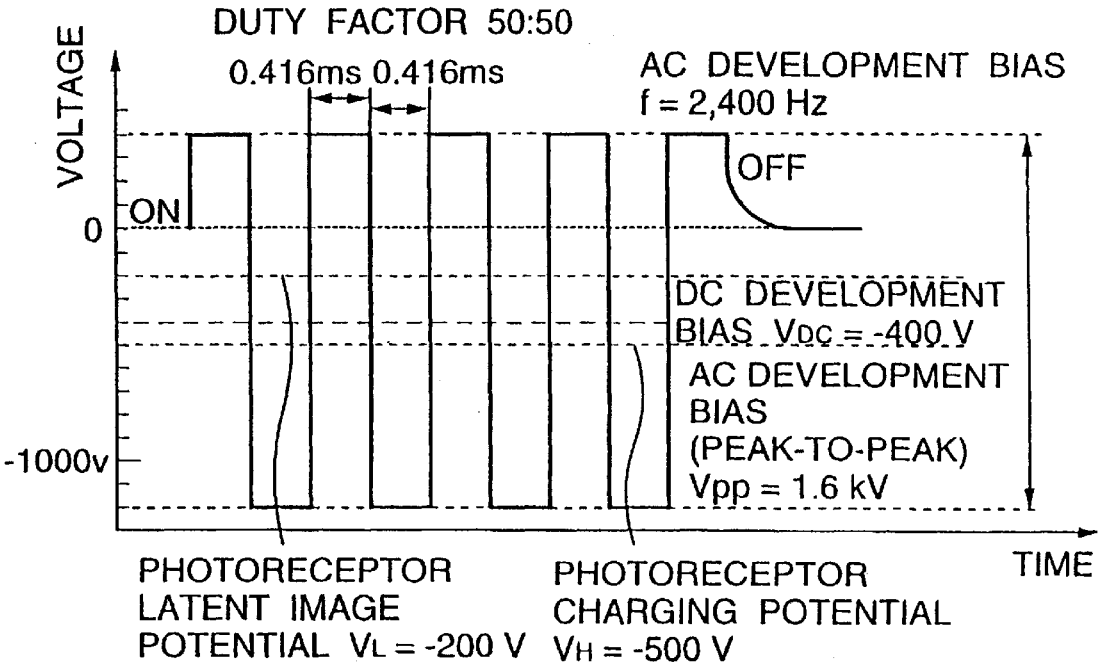
FIG. 5 is a waveform diagram showing how a development bias used in a conventional developing device is turned off.

The voltage that is output during on-periods can be adjusted in 255 steps in accordance with a digital value that is input from the CPU 51 to the internal D/A circuit 53. The digital signal as shown in FIG. 4 is amplified to a high-frequency, highvoltage bias as shown in FIG. 5 in accordance with its amplitude in passing through a driving circuit 55 and a boosting circuit 56. The DC bias can be set, by the capacitances of capacitors in a voltage detection circuit 57 shown in FIG. 3, at a constant voltage that is the center voltage of the AC bias. In this embodiment, the DC bias is set at −400 V.

With the above configuration, in the laser beam printer to which the developing device according to this embodiment is applied, the degree of toner sticking to the surface of the image carrying body (toner spewing phenomenon) occurring at the end of development in the developing device (image forming apparatus) using an AC development bias can be lowered, in the manner described below, as much as possible for differences among individual developing devices, various use environments, and variations with time without complicating the device or the image formation control, whereby a good image with no toner stain on the back surface of a sheet can be obtained under every combination of conditions.

Conventional electrophotographic image forming apparatuses employ, as the development bias, a sinusoidal or rectangular AC voltage having a 50:50 duty factor (the plus-side and minus-side periods are the same). However, in recent years, waveforms having deviated duty factors such as 40:60 and 30:70 have come to be used widely with an understanding that they are effective for improvement in development performance. A waveform having a deviated duty factor is formed by generating an AC waveform by amplifying a digital signal as shown in FIG. 4 or by using a signal for tuning on/off a high-voltage power source. Therefore, rectangular waveforms are generally employed. A pseudo sinusoidal wave or sawtooth wave can be easily generated by changing circuit constants relating to the rise and fall of a rectangular wave output.

Figure 6:
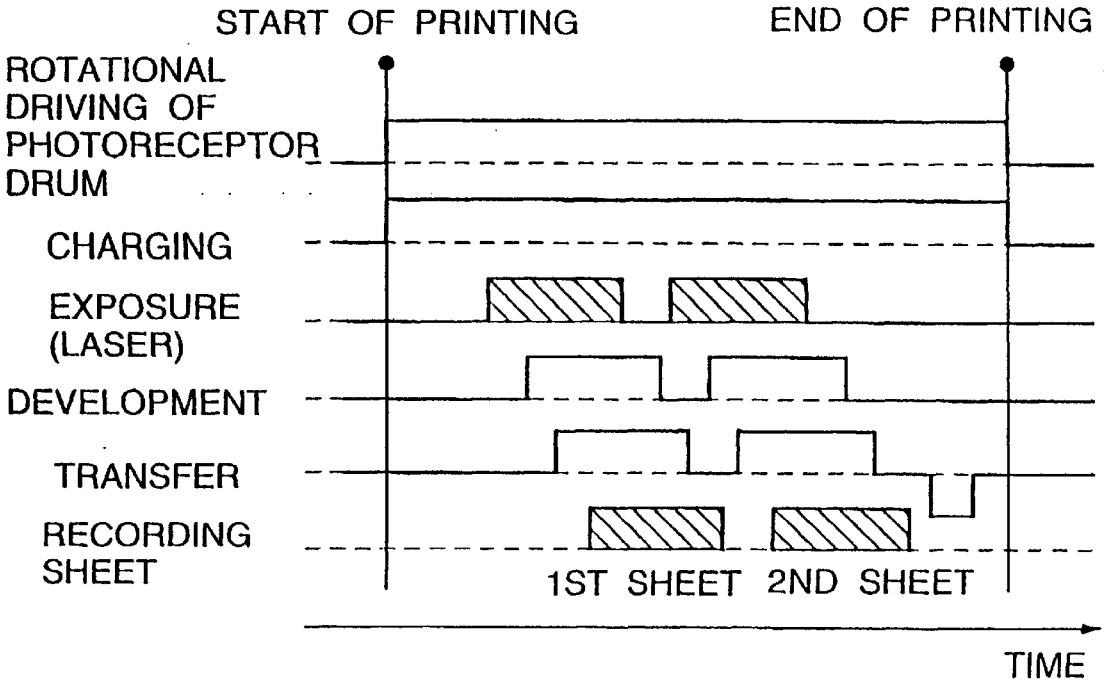
FIG.6 PRIOR ART
FIG. 6.is a timing chart of a printing operation on two consecutive sheets in the image forming apparatus according to the first embodiment.
Figure 7:
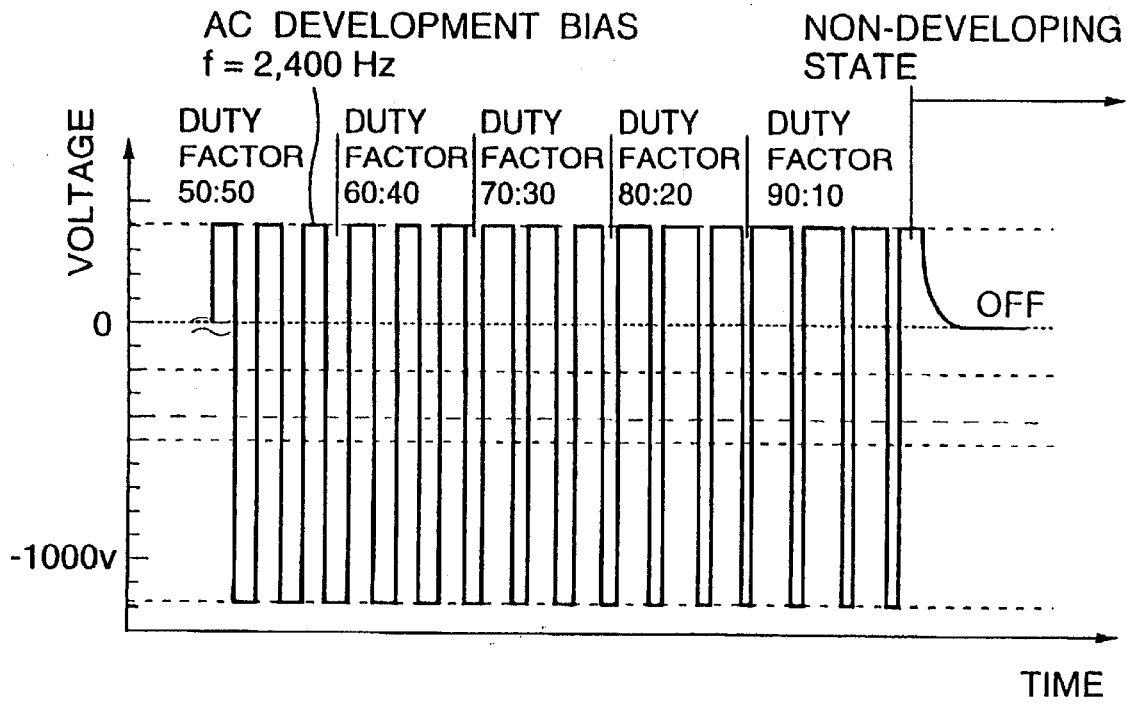
FIG. 7 is a waveform diagram showing how a development bias used in a developing device according to the first embodiment is turned off.

In response to a print command that has been processed by the image processing section 2 and supplied to the control device 34, driving of the photoreceptor drum 10 and charging of the charging roller 11 are started as shown in FIG. 6.

In the laser beam printer according to this embodiment, the circumferential speed of the photoreceptor drum 10 is 120 mm/s and in this state an AC voltage of 1.6 kV (peak-to-peak voltage) and a DC voltage of −500 V are applied to the charging roller 11. Therefore, a surface portion of the photoreceptor drum 10 that has passed through the charging region is uniformly charged at −500 V.

After the charged surface is subjected to image exposure by the exposing device 4, in exposed portions plus charges are generated from the photosensitive layer of the photoreceptor drum 10 and thereby a latent image of −150 V is formed.

The developing device 12, which is disposed downstream of the exposing region, has the developing roller 13 that is disposed to face the surface of the photoreceptor drum 10 with a gap of 0.35 mm interposed in between. The developing roller 13 carries a thin layer of developer (hereinafter referred to as "toner") on its surface and rotates so as to conform to the rotation of the photoreceptor drum 10. Although this embodiment is directed to the configuration in which the photoreceptor drum 10 and the developing roller 13 are not in contact with each other, the invention is effective not only in the non-contact scheme but also in the contact scheme in which the photoreceptor drum 10 and the developing roller 13 are in contact with each other.

The toner used in this embodiment is a magnetic one-component toner that is charged in the minus polarity when it passes through the pressurized contact region where the layer thickness restricting member 44 is in pressurized contact with the developing roller 13 that is rotating. In the case of a magnetic toner, the toner is bound to and held on the surface of the developing roller 13 by magnetic force of the magnet member that is located inside the developing roller 13. In the case of a non-magnetic one-component toner or a two-component toner, the toner is held by image force toward the surface of the developing roller 13 that is generated by charging of toner particles. It goes without saying that development is performed by utilizing the difference between the potential of the surface of the photoreceptor drum 10 and the development bias potential that is applied to the developing roller 13. Therefore, the development bias may have an AC component and the charging polarity may be plus though it is minus in this embodiment.

Figure 14:
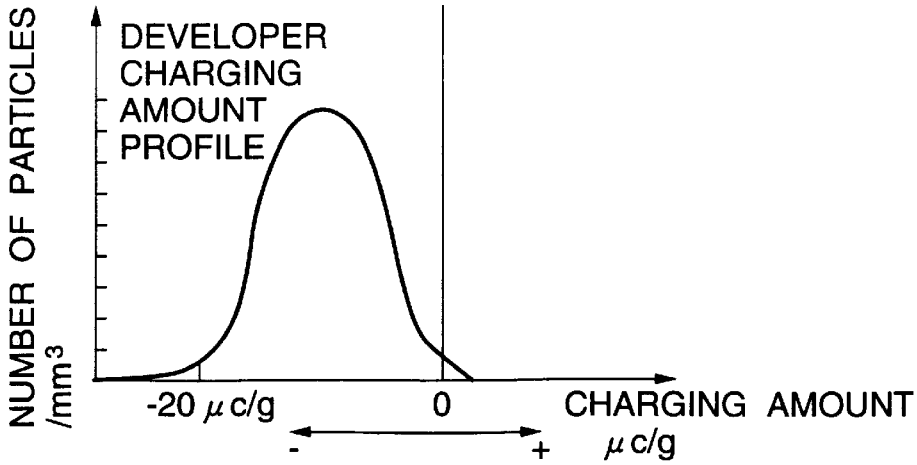
FIG. 14 is a graph showing a charging amount profile of a developer used in the developing device according to the first embodiment.

Toner particles that are carried, in the form of a thin layer, by the developing roller 13 are different in shape, size, and surface area and hence are slightly different in charging amount. Such a variation in the charging amount of a toner particle is common and it is known that such a variation has a profile as shown in FIG. 14.

Incidentally, a sheet sensor (not shown) is disposed in the vicinity of the transport route of a recording sheet 16 and its output signal is supplied to the control device 34. In this embodiment, based on the output of the sheet sensor the control device 34 sets time points when to turn on and off the development bias. Usually, the output signal of the sheet sensor that is disposed in the vicinity of the transport route is turned on when the sheet sensor detects the front end of a sheet and it is turned off when the sheet sensor detects passage of the rear end of the sheet. The control device 34 determines on/off timing of a development bias based on the above on and off time points of the output signal of the sheet sensor. The microcomputer 50 of the control device 34 causes a development bias to be applied to the developing roller 13 so as to be synchronized with arrival of the first latent image at the development position during image formation, and causes the development bias to be turned off after passage of the final latent image portion that depends on the recording sheet size.

As described above, during development the bias is formed by superimposing a DC voltage and an AC voltage on each other and the peak-to-peak value and the duty factor of the AC voltage can be changed by a command that is issued from the microcomputer 50. In this embodiment, a rectangular wave is used in which the DC voltage is −400 V, the frequency, the peak-to-peak value, and the duty factor of the AC voltage is 2,400 Hz, 1.6 kV, and 50:50, respectively.

An electrostatic latent image that is formed on the surface of the photoreceptor drum 10 is composed of background portions having a potential of −500 V and latent image portions having a potential of −150 V. Therefore, the electric field force acting on toner that is charged in the minus polarity by the DC development bias of −400 V applied to the developing roller 13 is in the direction from the surface of the photoreceptor drum 10 to the developing roller 13 for the background portions and in the direction from the developing roller 13 to the photoreceptor drum 10 for the latent image portions. The electric field force causes toner to be electrostatically absorbed on the surface of the photoreceptor drum 10 in the latent image portions to form a developed image there. It is known that at the same time there are toner particles that randomly fly to the background portions to cause stain such as minute black points in the background portions.

Once toner that is powder of minute particles is absorbed on the photoreceptor drum 10 in the background portions, absorption force called image force is added to electrostatic absorption force and hence it is difficult to return the toner to the developing roller 13 only by the electric field force that is generated by the DC voltage of the development bias.

This causes stain in the background portions, that is, a fog. To prevent such a fog and thereby form a developed image that is close to the latent image, a method is employed in which an AC electric field that is stronger than a DC electric field is formed by using a development bias in which an AC bias is superimposed on a DC bias and resulting electric field force causes toner particles to reciprocate between the developing roller 13 and the photoreceptor drum 10, whereby toner that is absorbed on the photoreceptor drum 10 in latent image portions is left there and fog-causing toner that has field to the background portions is returned to the developing roller 13.

The electric field due to the AC bias is stronger than that due to the DC bias (100-V contrast). In this embodiment, since the peak-to-peak value of the AC bias is 1.6 kV, an electric field that returns toner to the developing roller 13 is formed by 800-V contrast (i.e., a half of the peak-to-peak value) in each non-development-side AC phase though during a short time, whereby toner absorbed on the photoreceptor drum 10 in the background portions is peeled off and returned to the developing roller 13. In this manner, a good developed image that is free of a fog can be obtained.

As for latent image portions on the surface of the photoreceptor drum 10, the superimposition of the AC bias not only makes the developing power more stable by increasing the development contrast but also causes excess toner particles that are absorbed in the latent image portions to be returned to the developing roller 13 by the electric field force in non-development-side AC phases. This provides an advantage that a stable image density can always be secured.

When receiving an off signal from the sheet sensor that is disposed in the vicinity of the transport route of a recording sheet 16, the microcomputer 50 turns off the development bias as shown in the sequence timing chart of FIG. 6 at a predetermined time point after a time point when the final latent image portion that depends on the recording sheet size passes through the development region.

As for the definition of the off-state of the development bias, it is not limited to the state that voltage supply from the high-voltage power source section is stopped. The off-state includes a state that a low voltage close to 0 V is output as well as a state shown in FIG. 9 that although the application of an AC bias continues, a voltage close to 0 V is output in most of each AC cycle and the duration of a varying electric field is too short to impart development action by the electric field to toner particles.

In the gap development scheme used in this embodiment in which the gap is formed between the photoreceptor drum 10 and the developing roller 13, during application of a development bias what is called a toner cloud in which plural toner particles fly (reciprocate) at various positions is formed in the gap.

If the development bias is turned off in this state as shown in FIG. 5 (conventional control), the energy so far given to flying (reciprocating) toner particles disappears and hence toner particles located in the vicinity of the surface of the photoreceptor drum 10 are stuck to the surface of the photoreceptor drum 10 and toner particles located in the vicinity of the developing roller 13 are absorbed on the surface of the developing roller 13. Toner that is absorbed on the surface of the photoreceptor drum 10 at this time is spewed toner (mentioned above).

In contrast, where the development bias control according to the invention is used, all toner particles flying (reciprocating) in the gap are moved to the surface of the developing roller 13 by the applied development AC bias whose duty factor is modulated in a deviated manner and a toner cloud itself is absorbed on the developing roller 13.

Figure 10:
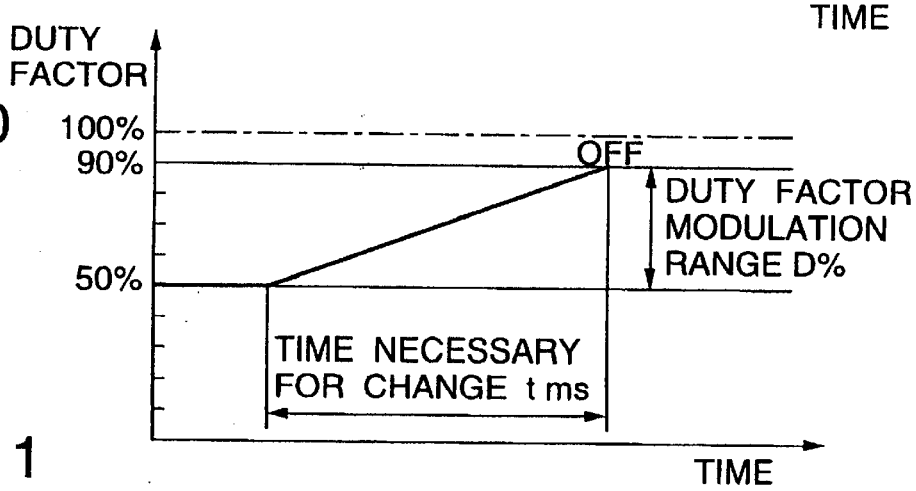
FIG. 10 is a graph showing a duty factor variation rate in the first embodiment.

More specifically, since as shown in FIG. 10 the duty factor of the portion of the AC bias voltage having the opposite polarity to the toner charging polarity is gradually increased, the portion of the applied AC developing bias that forms an electric field that returns toner particles to the developing roller 13, that is, the return electric field forming period, increases and the period in which an electric field moves toner particles in the opposite direction decreases. As a result, the time during which toner particles are moved toward the developing rollers 13 increases and finally all toner particles forming the toner cloud reach the surface of the developing roller 13. Even after the toner cloud is absorbed by the surface of the developing roller 13, electric fields for returning toner particles to the developing roller 13 continue to act on the toner particles on the surface of the developing roller 13. Therefore, the toner particles stop their flying movements though the development bias is still applied to the developing roller 13. Even if both of the DC bias and the AC bias are turned off at the same time in this state, no toner particles are stuck to the surface of the photoreceptor drum 10.

Figure 11:
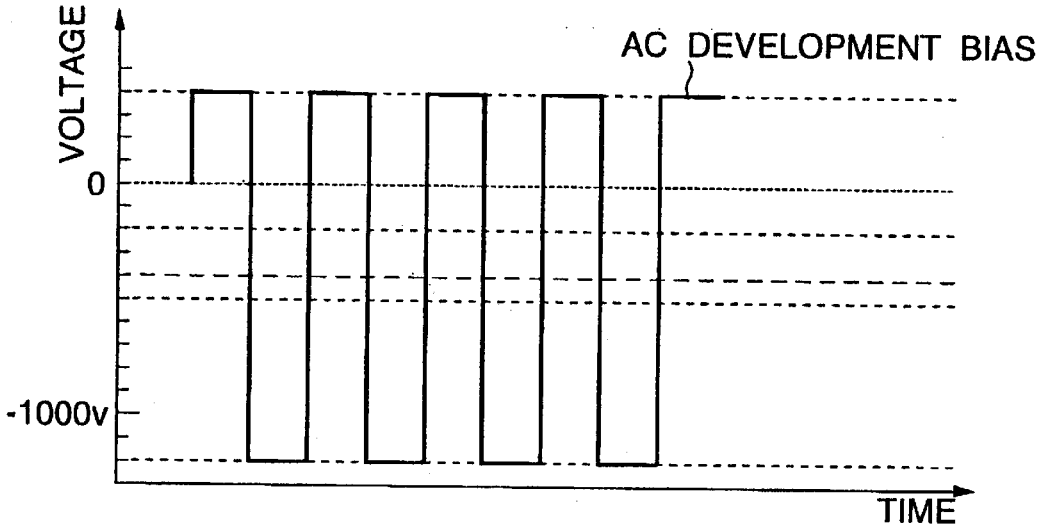
FIG. 11 shows a development bias waveform used in the developing device according to the first embodiment.
Figure 12:
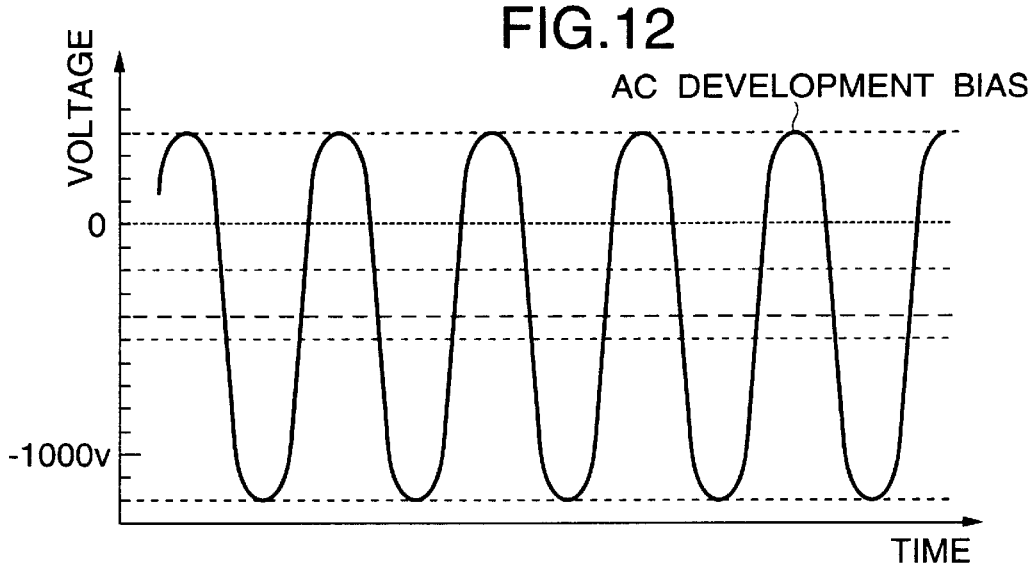
FIG. 12 shows another development bias waveform used in the developing device according to the first embodiment.
Figure 13:
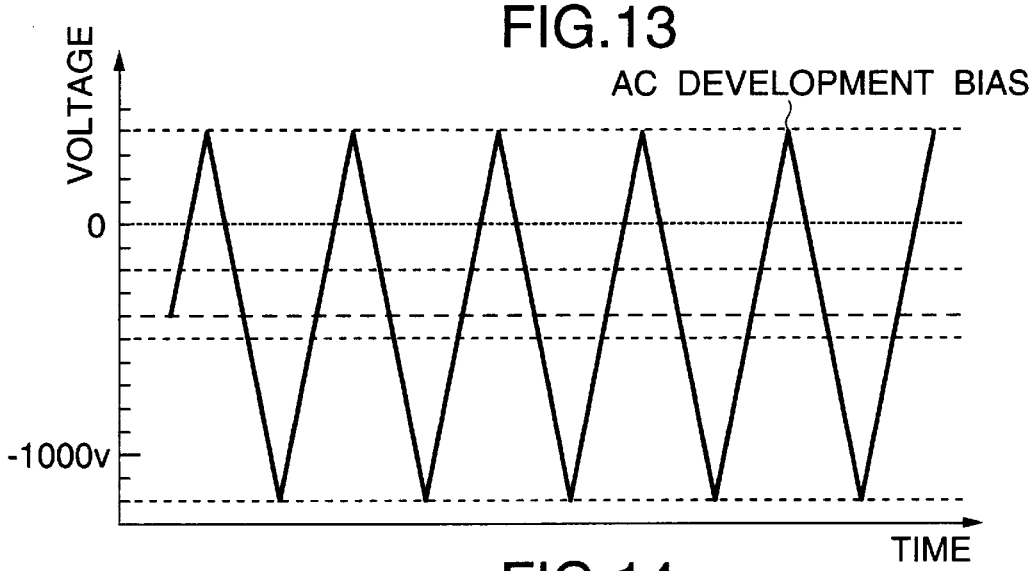
FIG. 13 shows a further development bias waveform used in the developing device according to the first embodiment.

The AC component of the development bias may be any of a rectangular wave as shown in FIG. 11, a sinusoidal wave as shown in FIG. 12, a sawtooth wave as shown in FIG. 13, and other waveforms.

Embodiment 2

Figure 8:
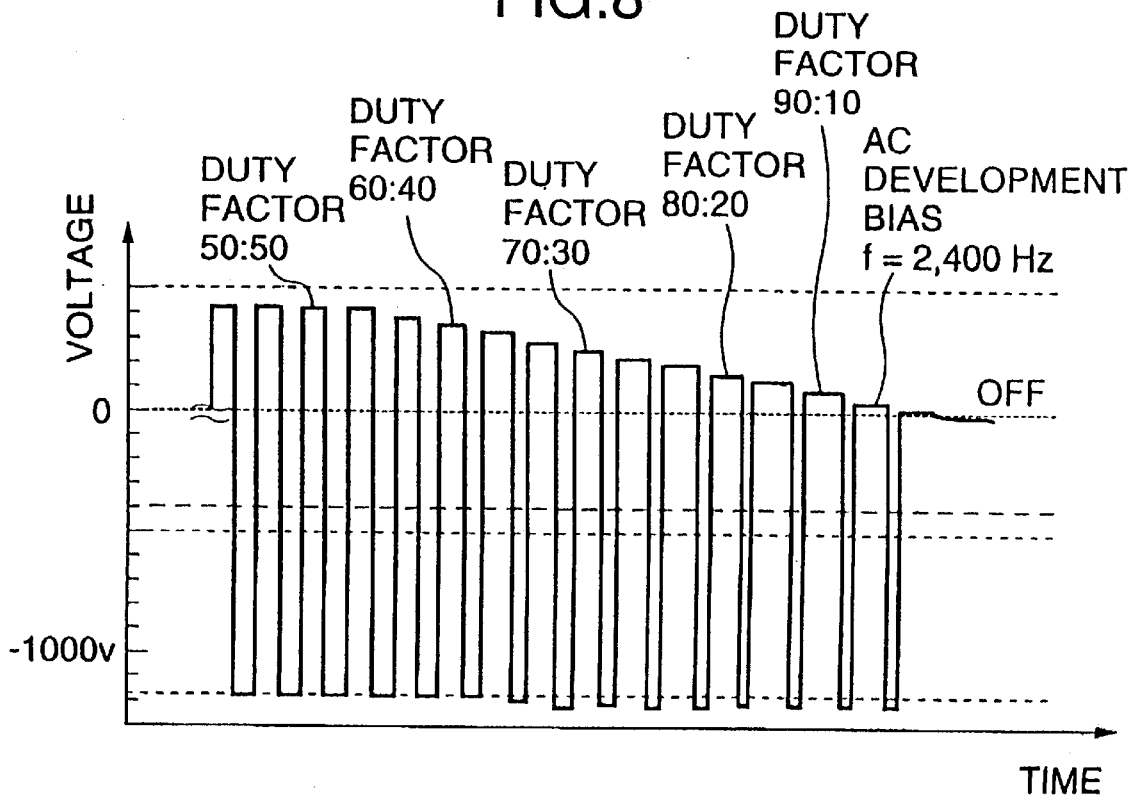
FIG. 8 is a waveform diagram showing how a development bias used in a developing device according to a second embodiment of the invention is turned off.

FIG. 8 shows a development bias waveform according to a second embodiment of the invention. The second embodiment will be described below by giving the same components as in the first embodiment the same reference numerals as given in the first embodiment. In the second embodiment, at a transition from a development state to a non-development state, a control is made in such a manner that not only is the duty factor of the portion of an AC bias voltage having the opposite polarity to the developer charging polarity increased gradually but also the peak value of the portions of an AC bias voltage having the opposite polarity to the developer charging polarity is converged to 0 V.

That is, in the second embodiment, while the duty factor of the applied development AC bias is modulated in a deviated manner, the peak-to-peak value of the AC bias is gradually decreased and the peak value of the portion having the phase for returning toner particles to the developing roller 13 is converged to 0 V as shown in FIG. 8. In this manner, all toner particles forming a toner cloud are moved to the surface of the developing roller 13 and then both of the DC bias and the AC bias are turned off at the same time, whereby undesired sticking of toner particles to the surface of the photoreceptor drum 10 can be prevented.

In particular, this embodiment provides a remarkable effect of preventing a phenomenon that toner particles are stuck to the surface of the photoreceptor drum 10 by an induction electric field that is generated by extinction of an electric field when the DC and AC development bias voltages are instantaneously interrupted.

This effect will be described below in more detail. As shown in FIG. 8, because of the employment of deviated duties, the development bias is close to 0 V in most of each cycle of the development AC bias and an electric field that moves toner particles from the developing roller 13 toward the photoreceptor drum 10, that is, a toner developing electric field, is formed only in a very short time.

Naturally, since the time during which such an electric field is formed is much shorter than the time during which an electric field in the opposite direction is formed, toner particles are given neither sufficient acceleration by electric field force nor movement time necessary to move toward the photoreceptor drum 10 and hence are bound to the surface of the developing roller 13.

If the AC and DC development bias voltages are turned off in this state, induction electromotive force is generated in such a direction as to compensate for the disappearing electric field and an induction electric field is generated instantaneously. As described above, the development bias is close to 0 V in most of each cycle and a minus electric field (shorter duty side) is generated. When this minus electric field disappears, an induction electric field is generated in the opposite direction as a plus electric field. Therefore, the induction electric field acts in such a direction as to bind toner particles having the minus polarity to the surface of the developing roller 13, and hence enhances the effect of preventing toner particles from sticking to the surface of the photoreceptor drum 10 at the time of instantaneous interruption of the development bias voltage.

Embodiment 3

Figure 9:
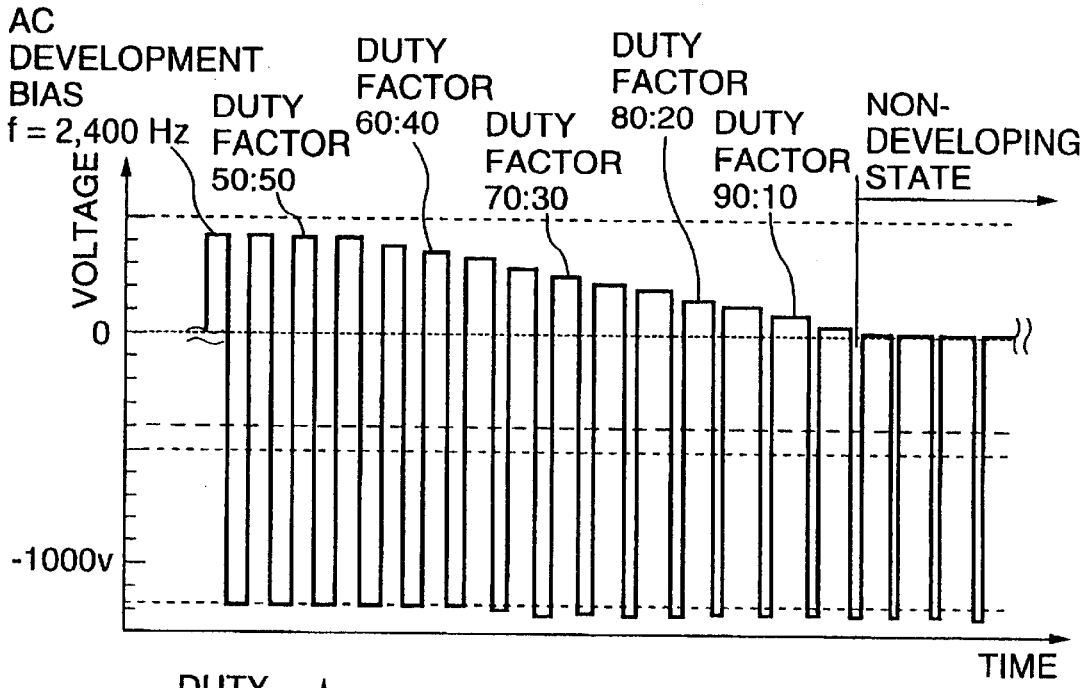
FIG. 9 is a waveform diagram showing how a development bias used in a developing device according to a third embodiment of the invention is turned off.

FIG. 9 shows a development bias waveform according to a third embodiment of the invention. The third embodiment will be described below by giving the same components as in the first embodiment the same reference numerals as given in the first embodiment. In the third embodiment, the control unit is configured in such a manner that at a transition from a development state to a non-development state the duty factor of the portion of the AC bias voltage having the opposite polarity to the developer charging polarity is gradually increased and the increasing of the duty factor is finished at a time point when the duty factor reaches a predetermined value that is 80% or more.

That is, in the third embodiment, as shown in FIG. 9, while the duty factor of the applied development AC bias is modulated in a deviated manner, the peak-to-peak value of the AC bias is gradually decreased and the peak value of the portion having the phase for returning toner particles to the developing roller 13 is converged to 0 V . When all toner particles forming a toner cloud have reached the surface of the developing roller 13, the development bias is turned off. In this case, the DC and AC development bias voltages are turned off at the same time as the rotational driving of the photoreceptor drum 10 and the supply of the charging bias thereto are stopped after the end of the printing of the second page in the timing chart of FIG. 6. The third embodiment can also prevent undesired sticking of toner particles to the surface of the photoreceptor drum 10, because not only does an electric field for returning toner particles to the developing roller 13 continue to act on the toner on the surface of the developing roller 13 even after a toner cloud is absorbed by the surface of the developing roller 13 but also no induction electric field is generated when the above electric field disappears.

The dependence of the development performance of toner particles on the degree of deviation of the duty factor of the development AC bias in the third embodiment will be described below. As described above, the background potential of the surface of the photoreceptor drum 10 is −500 V, the potential of an exposed latent image is −150 V, and the development DC bias applied to the developing roller 13 is −400 V. Therefore, the development contrast, that is, the DC voltage for development, which is generally defined by |(development DC bias)−(latent image potential)|, is equal to 250 V.

That is, development is performed by setting the steady development voltage excluding the AC bias at 250 V and superimposing to it a rectangular AC bias of 1.6 kV having a 50% duty factor. If the density of a toner image formed on a recording sheet with this voltage difference is measured in terms of the reflection density, a reflection density value of about 1.5 is obtained.

If image formation is performed by using the same development setting and forming a latent image having a potential of −250 V by properly controlling the exposure amount, a reflection density value of 0.8 is obtained. If image formation is performed by using the same development setting and forming a latent image having a potential of −320 V in a similar manner, a reflection density value of 0.2 is obtained, in which case only a very light image can be formed.

Figure 15:
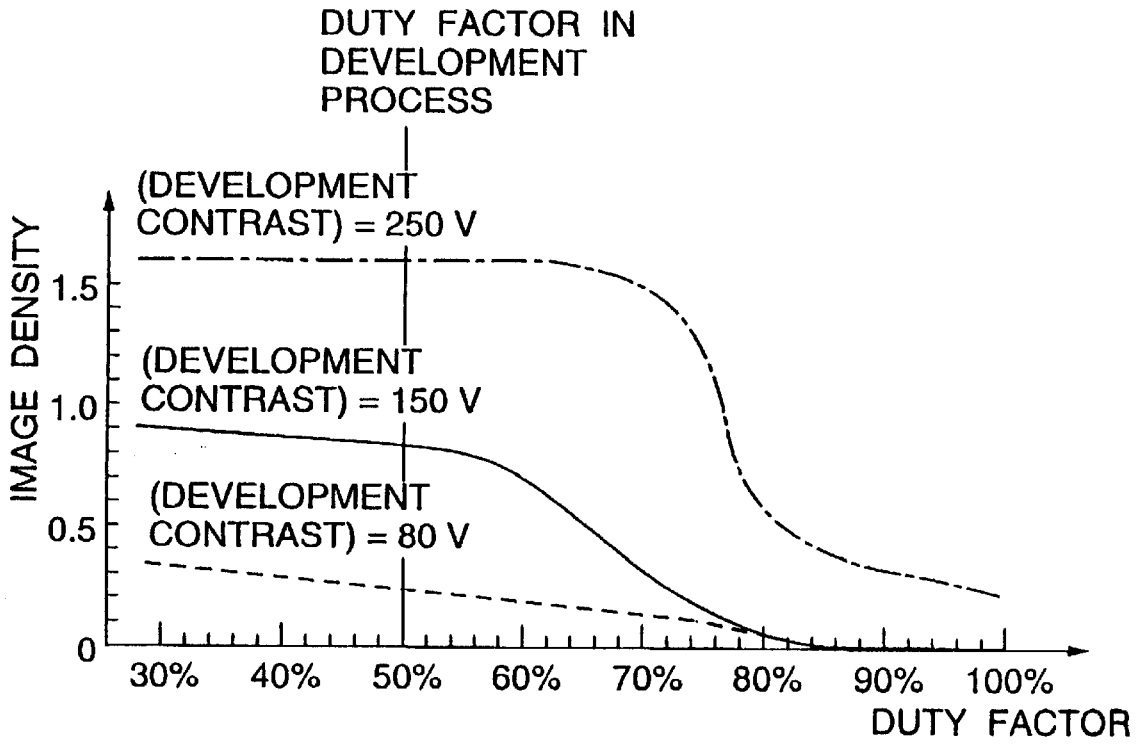
FIG. 15 is a graph showing variations of densities obtained by developing latent images when the duty factor of a development AC bias is changed.

FIG. 15 shows variations of image reflection densities that are obtained with latent images having the above three kinds of potentials when the plus-side duty factor of the AC bias is increased.

It is seen that with each latent image potential the toner development amount decreases and the degree of development lowers as the duty factor of the plus-side (the polarity opposite to the toner charging polarity) is increased. In particular, after the duty factor exceeds about 80%, as the duty factor is increased the image density steeply decreases irrespective of the development contrast. It is estimated that this point is a threshold for such specific characteristics as a toner diameter and a charging amount used in this embodiment.

The particle diameter of the minus-polarity toner used in this embodiment is distributed over about 3–10 $\mu$m and its average particle diameter is 7 $\mu$m. The charging amount is distributed as shown in FIG. 14 and the average charging amount is about −10 $\mu$C/g. These toner characteristics are common ones for current image forming apparatuses using electrophotography.

Further, the charging potential and the latent image potential of the photoreceptor drum 10 and the development potential used in this embodiment are generally equal to those employed in image forming apparatuses using a magnetic developer.

Since development is performed with approximately the same electric field, it is readily expected that the image reflection density would vary in the same manner as the duty factor of the portion of the AC bias having the opposite polarity to the toner charging polarity is increased and it is considered that a threshold would similarly exist near a duty factor of 80%.

FIG. 15 is a plot of variations of image reflection densities with the development contrast as a parameter. For individual duty factors, spewed toner amounts were measured after the development bias was instantaneously interrupted. Similarly, no toner spewing occurred when the duty factor was larger about 80%.

A description will be made of the variation rate of the duty factor. It is not the case that toner particles complete one go-and-return movement between the photoreceptor drum 10 and the developing roller 13 in one cycle of the AC bias. Instead, as described above, toner particles that will finally contribute to development form a cloud in the gap and are absorbed on the surface of the photoreceptor drum 10 after gradually approaching it. There may occur events that toner behavior cannot follow a rapid variation in duty factor and toner particles come to stick to the surface of the photoreceptor drum 10, and that as described above a rapid variation of a development electric field causes an induction electric field in the opposite direction, that is, in such a direction that toner particles are moved toward the photoreceptor drum 10, and toner particles come to stick to the surface of the photoreceptor drum 10.

Experiments of the inventor have shown that when the variation rate of the duty factor is lower, the amount of toner that sticks to the photoreceptor drum 10 because it cannot follow a variation in the duty factor of the AC voltage of the development AC bias is smaller and the phenomenon is less problematic.

Figure 16:
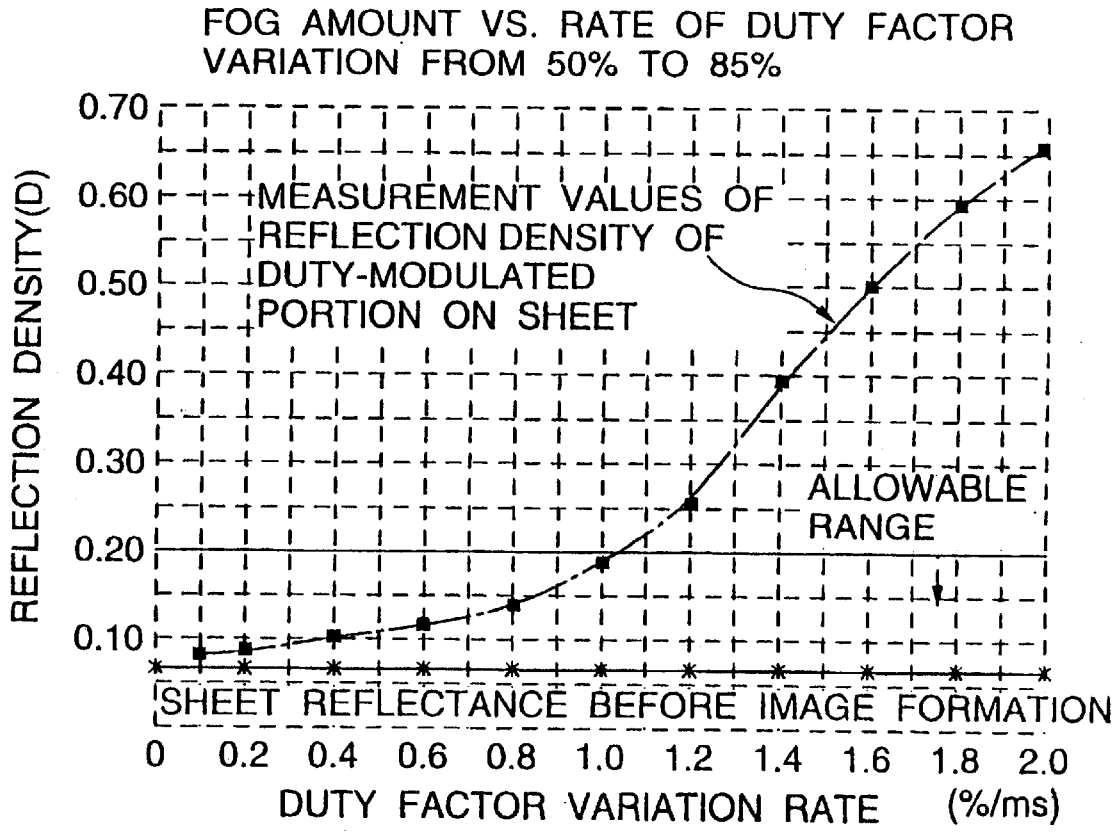
FIG. 16 is a graph showing a relationship between the variation rate of the duty factor of a development AC bias and the reflection density.

FIG. 16 shows a result of an experiment in which toner that stuck to the photoreceptor drum 10 during variation of the duty factor from 50% to 85% (the variation rate of the duty factor was changed) was transferred to a sheet and a reflection density was measured with a reflection density meter.

The reflection density value of a sheet surface before image formation somewhat varies depending on the kind of sheet and the gloss and is generally in a range of 0.04–0.15. The sheets used in this experiment had a reflection density value of 0.07 before image formation. Therefore, a reflection density measurement value of 0.07 should be obtained in a case where no toner is stuck to a sheet.

The rate of the duty factor variation from 50% to 85% was increased under the above conditions. As shown in FIG. 16, the reflection density value increased as the variation rate was increased.

When the reflection density is larger than 0.20, a sheet surface that is stained by streaks of stuck toner can be recognized even by visual observation. Therefore, the variation rate should be lower than 1.0%/ms.

As described above, the invention makes it possible to prevent the phenomenon that toner is spewed to the surface of the image carrying body when a development bias including an AC component that is applied to the developer carrying body during image formation is turned off without causing any secondary problems under any use environment of an image forming apparatus, thereby providing stable image quality that is free of staining of the back surface of a sheet and like problems.

What is claimed is:

1. A developing device in which a developer carrying body that carries a developer is disposed to face an image carrying body and an electrostatic latent image formed on the image carrying body is developed by applying a bias voltage in which DC and AC components are superimposed on each other to the developer carrying body, comprising:

a control unit that performs, at a transition from a developing state to a nondeveloping state, a control that both of the superimposed DC and AC components are instantaneously interrupted after a duty factor of a portion of the AC component having an opposite polarity to a developer charging polarity is gradually increased.

2. A developing device in which a developer carrying body that carries a developer is disposed to face an image carrying body and an electrostatic latent image formed on the image carrying body is developed by applying a bias voltage in which DC and AC components are superimposed on each other to the developer carrying body, comprising:

a control unit that performs, at a transition from a developing state to a non-developing state, a control that a duty factor of a portion of the AC component having an opposite polarity to a developer charging polarity is gradually increased and a peak value of the portion of the AC component having the opposite polarity to the developer charging polarity is converged to 0 V.

3. The developing device according to claim 1, wherein the control unit stops increasing the duty factor at a time point when the duty factor has reached a prescribed value that is 80% or more.

4. The developing device according to claim 1, wherein the control unit sets a rate of increasing the duty factor at 1.0%/ms or less.

5. The developing device according to claim 1, wherein the control unit instantaneously interrupts both of the superimposed DC and AC components in such a phase range that the AC component has the opposite polarity to the developer charging polarity.

6. An image forming apparatus in which an electrostatic latent image corresponding to desired image information is formed on an image carrying body, a developer carrying body that carries a developer is disposed to face the image carrying body, and the electrostatic latent image formed on the image carrying body is developed by applying a bias voltage in which DC and AC components are superimposed on each other to the developer carrying body, comprising:

a control unit that performs, at a transition from a developing state to a non-developing state, a control that both of the superimposed DC and AC components are instantaneously interrupted after a duty factor of a portion of the AC component having an opposite polarity to a developer charging polarity is gradually increased.

7. An image forming apparatus in which an electrostatic latent image corresponding to desired image information is formed on an image carrying body, a developer carrying body that carries a developer is disposed to face the image carrying body, and the electrostatic latent image formed on the image carrying body is developed by applying a bias voltage in which DC and AC components are superimposed on each other to the developer carrying body, comprising:

a control unit that performs, at a transition from a developing state to a non-developing state, a control that a duty factor of a portion of the AC component having an opposite polarity to a developer charging polarity is gradually increased and a peak value of the portion of the AC component having the opposite polarity to the developer charging polarity is converged to 0 V.

* * * * *